US010753670B2

(12) United States Patent
Xia et al.

(10) Patent No.: US 10,753,670 B2
(45) Date of Patent: Aug. 25, 2020

(54) REFRIGERATOR DOOR AND METHOD OF MANUFACTURING SAME

(71) Applicant: QINGDAO HAIER JOINT STOCK CO., LTD., Qingdao, Shandong Province (CN)

(72) Inventors: Enpin Xia, Qingdao (CN); Hao Zhang, Qingdao (CN); Guoshun He, Qingdao (CN); Xiaobing Zhu, Qingdao (CN)

(73) Assignee: QINGDAO HAIER JOINT STOCK CO., LTD., Qingdao, Shandong Province (CN)

( * ) Notice: Subject to any disclaimer, the term of this patent is extended or adjusted under 35 U.S.C. 154(b) by 0 days.

(21) Appl. No.: 16/327,795

(22) PCT Filed: Dec. 29, 2016

(86) PCT No.: PCT/CN2016/112819

§ 371 (c)(1),
(2) Date: Feb. 22, 2019

(87) PCT Pub. No.: WO2018/036058

PCT Pub. Date: Mar. 1, 2018

(65) Prior Publication Data

US 2019/0234678 A1 Aug. 1, 2019

(30) Foreign Application Priority Data

Aug. 22, 2016 (CN) ..... 2016 1 0702930

(51) Int. Cl.

| | |
|---|---|
| ***F25D 23/02*** | (2006.01) |
| ***F21V 33/00*** | (2006.01) |
| ***F25D 29/00*** | (2006.01) |
| *F21W 131/305* | (2006.01) |

(52) U.S. Cl.

CPC ..... *F25D 23/028* (2013.01); *F21V 33/0044* (2013.01); *F25D 23/02* (2013.01);
(Continued)

(58) Field of Classification Search

CPC . F25D 2400/36; F25D 23/028; F25D 2323/02
See application file for complete search history.

(56) References Cited

U.S. PATENT DOCUMENTS 8,622,487 B2 * 1/2014 Jung ..... D06F 39/12 312/204
2010/0019639 A1 * 1/2010 Son ..... F25D 23/02 312/403

(Continued)

FOREIGN PATENT DOCUMENTS

CN 102401527 A * 4/2012
CN 102401527 A 4/2012

(Continued)

OTHER PUBLICATIONS

Lee et al, Register control algorithm for high resolution multilayer printing in the roll-to-roll process, Feb. 2015, Mechanical Systems and Signal Processing (Year: 2015).*

*Primary Examiner* — Evan P Dzierzynski
*Assistant Examiner* — Keith G. Delahoussaye
(74) *Attorney, Agent, or Firm* — Cheng-Ju Chiang

(57) ABSTRACT

A refrigerator door and a method of manufacturing the same. The refrigerator door comprises a frame, a glass panel disposed at an outer side of the frame, and a LOGO display device disposed between the glass panel and the frame. A transparent LOGO display area is provided on the glass panel. The LOGO display device comprises a light-emitting component and a one-way vision film. The light-emitting component is disposed on one side of the LOGO display area towards the frame. The one-way vision film is disposed between the LOGO display area and the light-emitting component. The method of manufacturing the refrigerator door controls a printing error within 0.5 mm. The LOGO of the refrigerator door can emit light, has sharp and clear display, and is elegant in appearance.

16 Claims, 3 Drawing Sheets

(52) U.S. Cl.
CPC ..... *F25D 29/005* (2013.01); *F21W 2131/305* (2013.01); *F25D 2323/02* (2013.01); *F25D 2400/18* (2013.01); *F25D 2400/36* (2013.01); *F25D 2700/04* (2013.01)

(56) References Cited

U.S. PATENT DOCUMENTS

| | | | | |
|---|---|---|---|---|
| 2010/0313592 | A1* | 12/2010 | Pae | F25D 23/02 62/264 |
| 2012/0061405 | A1* | 3/2012 | Kwon | F25D 23/028 220/592.02 |
| 2013/0119847 | A1* | 5/2013 | Seo | F25D 23/028 312/405 |
| 2015/0009665 | A1* | 1/2015 | Durkee | G04B 45/00 362/231 |
| 2015/0113841 | A1* | 4/2015 | Ebrom | H05K 1/0274 40/451 |
| 2016/0010845 | A1* | 1/2016 | Brown | F25D 3/08 362/551 |
| 2017/0089633 | A1* | 3/2017 | Kim | A47L 15/4293 |

FOREIGN PATENT DOCUMENTS

| | | | |
|---|---|---|---|
| CN | 202373238 | U | 8/2012 |
| CN | 103412690 | A | 11/2013 |
| CN | 203731782 | U | 7/2014 |
| CN | 106123462 | A | 11/2016 |
| CN | 206056087 | U | 3/2017 |
| KR | 10-2014-0105900 | A | 9/2014 |

* cited by examiner

REFRIGERATOR DOOR AND METHOD OF MANUFACTURING SAME

CROSS REFERENCE TO RELATED APPLICATION

The present application is a 35 U.S.C. § 371 National Phase conversion of International (PCT) Patent Application No. PCT/CN2016/112819, filed on Dec. 29, 2016, which claims the priority of the Chinese patent application No. 201610702930.0 filed on Aug. 22, 2016 and with the title of "Refrigerator Door and Method of Manufacturing Same", which is incorporated herein in its entirety by reference. The PCT International Patent Application was filed and published in Chinese.

TECHNICAL FIELD

The present invention relates to a refrigerator door and a manufacturing method thereof.

BACKGROUND

Common methods for a LOGO required to be marked on a door body of an existing refrigerator comprise printing, stamping and attaching. However, LOGOs formed through the above methods are monotonous, and never change during use. As a result, users are prone to get bored with them.

In view of this, it is necessary to improve an existing refrigerator door and a manufacturing method thereof to solve the above problem.

SUMMARY

An object of the present invention is to provide a refrigerator door and a manufacturing method thereof to solve a problem that LOGOs on existing refrigerator door bodies are monotonous.

In order to achieve the above object, the present invention provides a refrigerator door, comprising: a frame, a glass panel arranged outside the frame, and a LOGO display device arranged between the frame and the glass panel, wherein a transparent LOGO display area is printed on the glass panel; the LOGO display device comprises a light-emitting component and a one-way vision film; the light-emitting component is arranged at a side of the LOGO display area close to the frame; and the one-way vision film is arranged between the LOGO display area and the light-emitting component.

As an improvement of the present invention, a side of the LOGO display area close to the one-way vision film is coated with an optically clear adhesive to enable the surface of the LOGO display area to be flat.

As a further improvement of the present invention, the light-emitting component comprises a light-emitting plate and a light smoothing cover plate arranged between the light-emitting plate and the one-way vision film; a lateral side of the light smoothing cover plate is provided with a clamping portion; a lateral side of the light-emitting plate is provided with a buckling portion; and the clamping portion and the buckling portion cooperate to fixedly connect the light-emitting plate and the light smoothing cover plate.

As a further improvement of the present invention, the light-emitting component further comprises a supporting plate; connecting holes are correspondingly formed in the light-emitting plate and the supporting plate; and the light-emitting component further comprises a connecting member which passes through the connecting holes to fixedly connect the light-emitting plate and the supporting plate.

As a further improvement of the present invention, a limiting protrusion is arranged at a side of the supporting plate away from the light-emitting plate, and is abutted against the frame to press the one-way vision film, so that the one-way vision film clings to the LOGO display area.

As a further improvement of the present invention, a human body sensing device is arranged on the refrigerator door, and is electrically connected to the LOGO display device.

The present invention further provides a method of manufacturing the above-mentioned refrigerator door, and the method of manufacturing the refrigerator door comprises the following steps:

providing a frame;

providing a glass panel; printing a LOGO display area on the glass panel by using a multi-layer printing process, wherein a hollowed-out area is arranged on each printing layer, the hollowed-out areas on the multi-layer printing layers form the LOGO display area correspondingly, and an error between the hollowed-out areas of the multi-layer printing layers is controlled to be less than 0.5 mm;

assembling the frame and the glass panel together;

providing a LOGO display device which comprises a one-way vision film and a light-emitting component; attaching the one-way vision film on the LOGO display area; and foaming between the glass panel and the frame to form a foaming layer;

reserving an accommodating space at a side of the LOGO display area facing the frame, wherein the accommodating space has an opening; and mounting the light-emitting component into the accommodating space through the opening.

As an improvement of the present invention, attaching the one-way vision film on the LOGO display area is performed under a negative pressure environment.

As a further improvement of the present invention, before attaching the one-way vision film on the LOGO display area, the LOGO display area is coated with an optically clear adhesive.

The present invention further provides another method of manufacturing the above-mentioned refrigerator door, and the method of manufacturing the refrigerator door comprises the following steps:

providing a frame;

providing a glass panel; printing a LOGO display area on the glass panel, wherein a printing error is controlled to be less than 0.5 mm;

assembling the frame and the glass panel together;

providing a LOGO display device which comprises a one-way vision film and a light-emitting component; attaching the one-way vision film on the light-emitting component; and foaming between the glass panel and the frame to form a foaming layer; reserving an accommodating space at a side of the LOGO display area facing the frame, wherein the accommodating space has an opening; mounting the light-emitting component with the one-way vision film into the accommodating space from the opening; and enabling the one-way vision film to be fit with the LOGO display area.

The beneficial effects of the refrigerator door and the method of manufacturing same provided by the present invention are as follows. By printing the transparent LOGO display area on the glass door body, and arranging the one-way vision film and the light-emitting component on the side of the LOGO display area, the LOGO display area exhibits at least two states when the light-emitting component emits or does not emit light. In the manufacturing method of the refrigerator door, by improving the printing accuracy and reducing the printing error, a problem of a fuzzy LOGO display area boundary in the prior art is solved.

DETAILED DESCRIPTION

In order to explain the objects, technical solutions and advantages of the present invention more apparently, the present invention is further described in detail below with reference to the accompanying drawings and specific embodiments.

Figure 1:
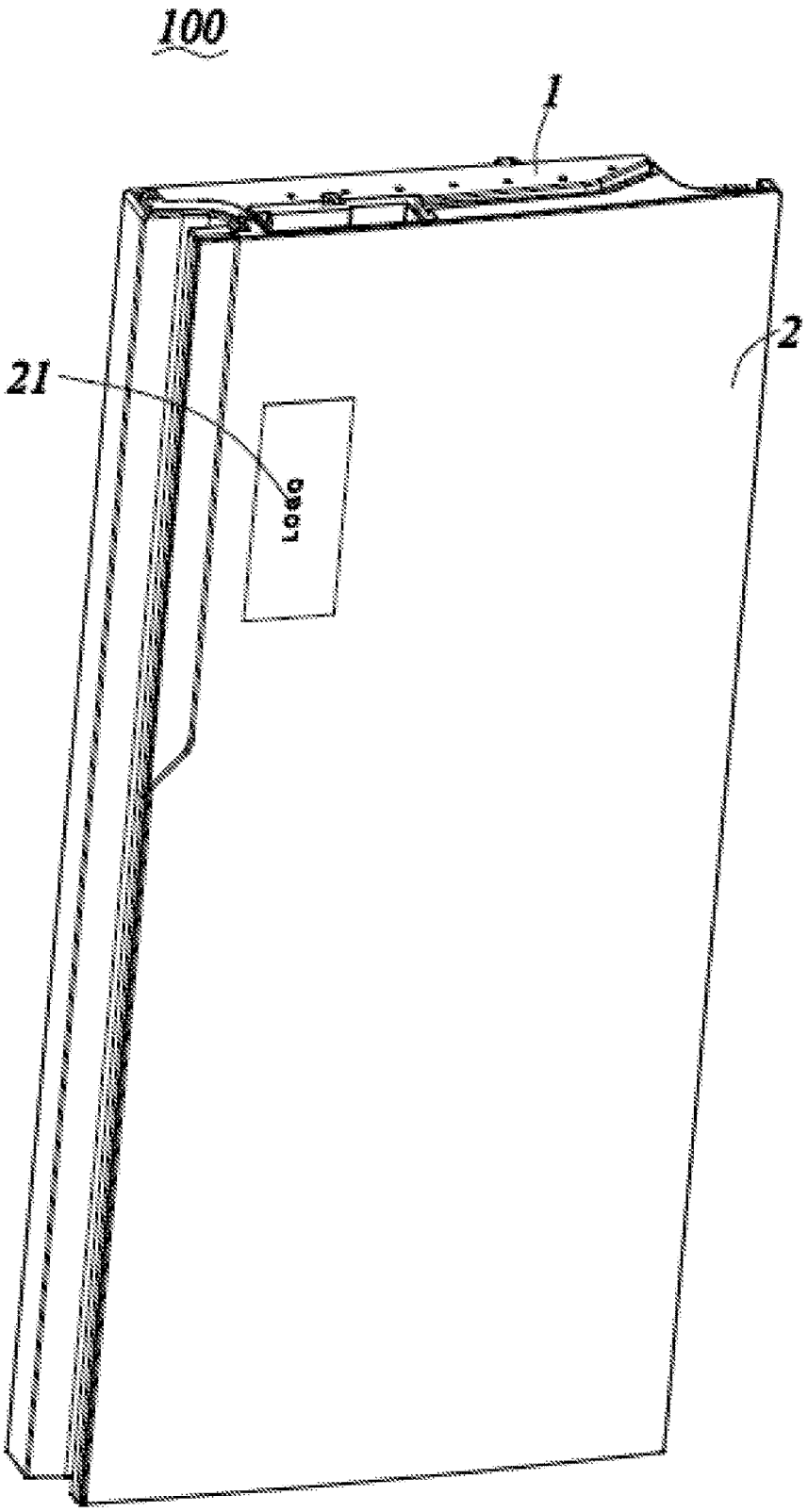
FIG. 1 is a schematically structural view of an overall structure of a refrigerator door of the present invention.
Figure 2:
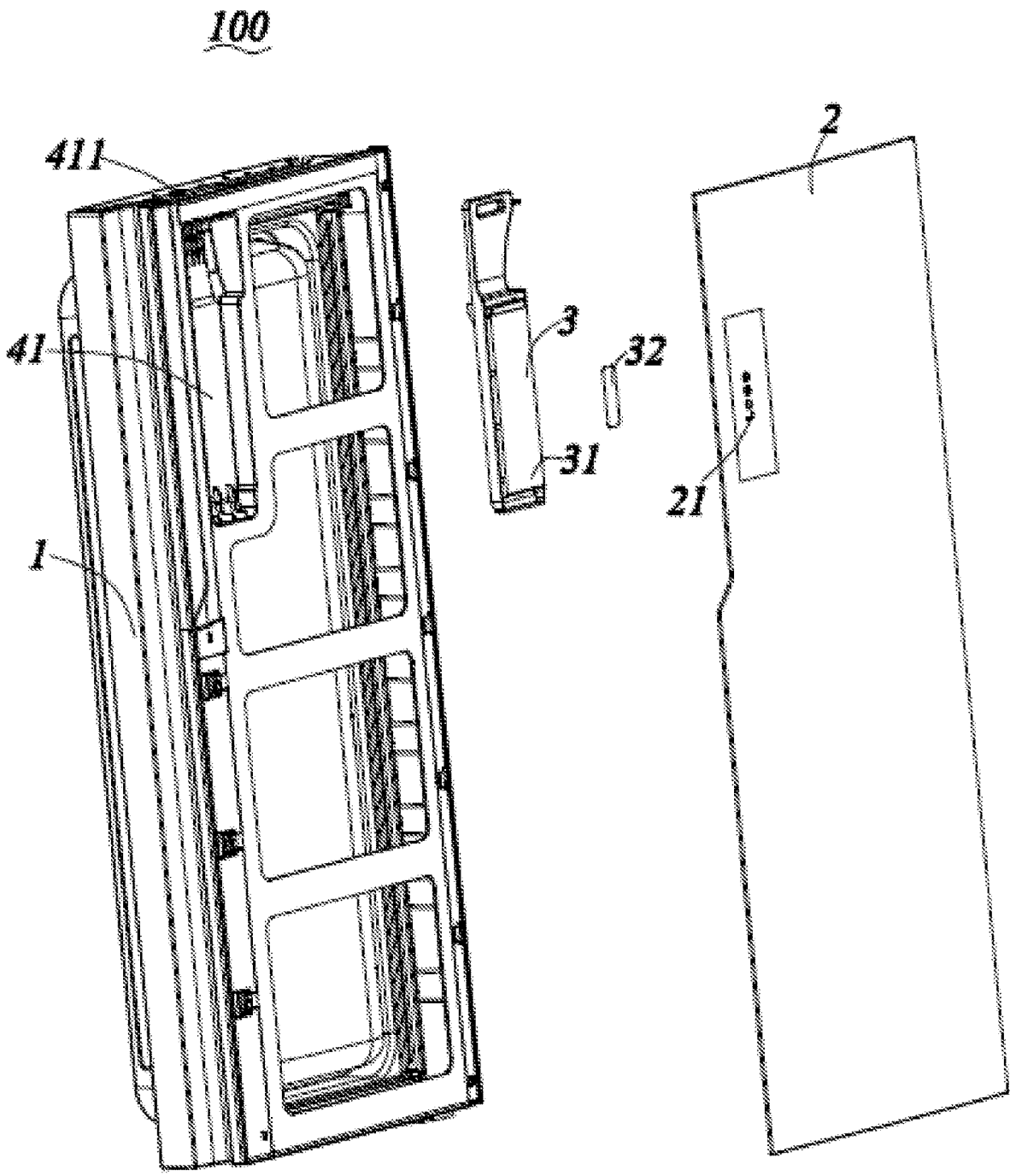
FIG. 2 is a schematically exploded view of the refrigerator door of the present invention.
Figure 3:
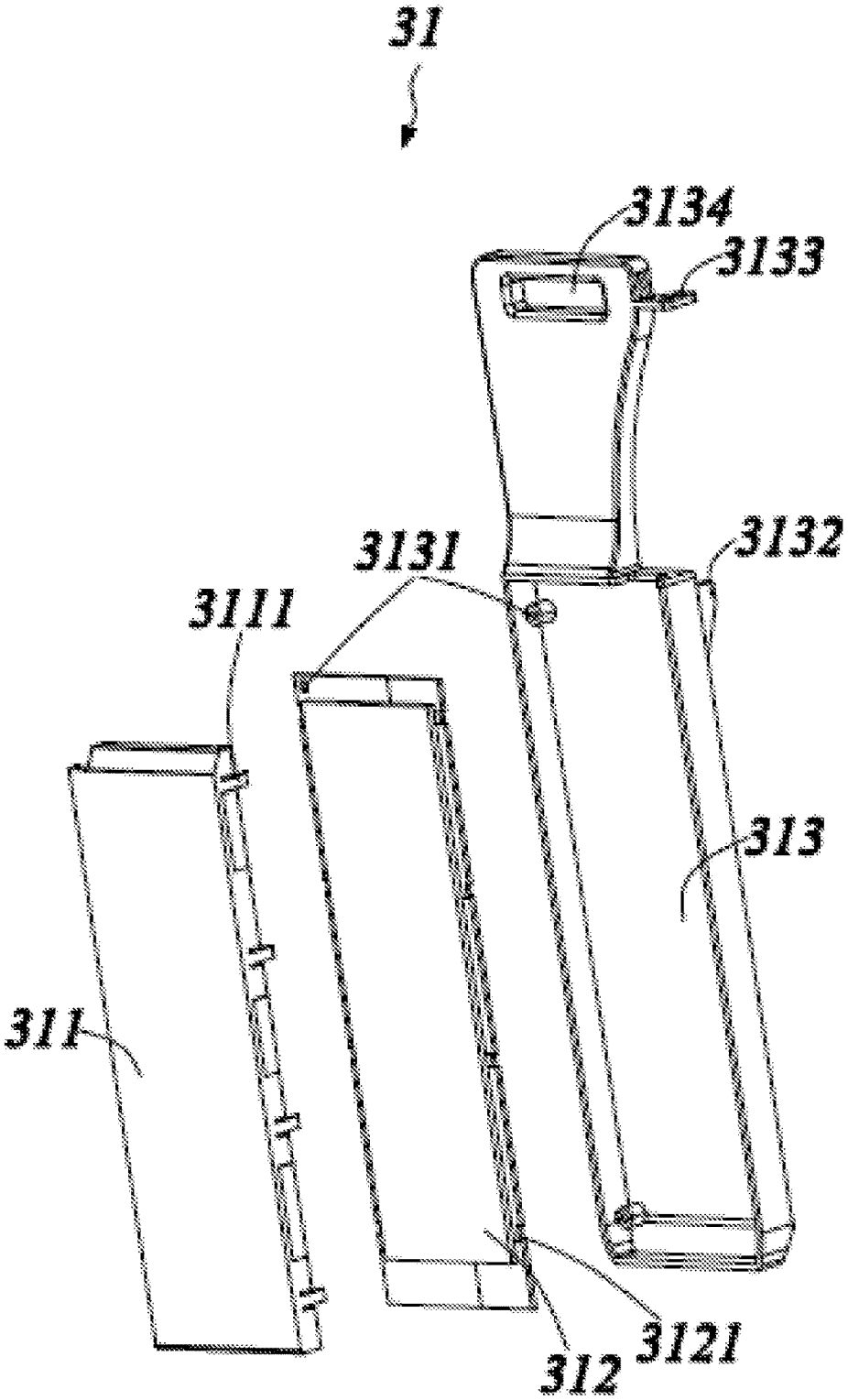
FIG. 3 is a schematically exploded view of a light-emitting component in FIG. 2.

As shown in FIGS. 1-3, a refrigerator door 100 of the present invention comprises a frame 1, a glass panel 2 arranged outside the frame 1, a foaming layer (not shown in the Figs.) located between the frame 1 and the glass panel 2, a LOGO display device 3 arranged between the frame 1 and the glass panel 2, and a human body sensing device (not shown in the Figs.).

A transparent LOGO display area 21 is printed on the glass panel 2, and an area around the LOGO display area 21 is non-transparent. The LOGO display area 21 corresponds to a LOGO pattern required to be displayed, and of course, may display other patterns, stripes, or the like, which are not limited in the present invention. As an existing printing method such as screen printing will generate an ink layer on the glass panel 2 to form stepped protrusions, in the embodiment, a side of the LOGO display area 21 facing the frame 1 is coated with an optically clear adhesive to enable the surface of the LOGO display area 21 to be flat. In addition, a printing error in the existing printing method is relatively larger, resulting in a relatively fuzzy boundary of the LOGO display area 21. In the embodiment, the LOGO display area 21 is printed by using a multi-layer printing process; a hollowed-out area is arranged on each printing layer; the hollowed-out areas on the multi-layer printing layers form the LOGO display area 21 correspondingly; and an error between the hollowed-out areas of the multi-layer printing layers is controlled to be less than 0.5 mm, so that the boundary of the LOGO display area 21 of the present invention is clear.

The LOGO display device 3 comprises a light-emitting component 31 and a one-way vision film 32.

The one-way vision film 32 is arranged between the LOGO display area 21 and the light-emitting component 31, and is directly attached to the LOGO display area 21 or the light-emitting component 31 by using a glue. As the LOGO display area 21 is coated with an optically clear adhesive, the one-way vision film 32 and the LOGO display area 21 can be closely adhered to each other without bubbles, and the light emitted by the light-emitting component 31 will not be refracted due to the bubbles. In the embodiment, the one-way vision film 32 is a mirror-like silver transparent film. When the light-emitting component 31 does not emit light, the LOGO display area 21 displays a mirror-like silver color; and when the light-emitting component 31 emits light, the LOGO display area 21 allows the light to transmit and displays a bright silver color.

The light-emitting component 31 comprises a light-emitting plate 312, a light smoothing cover plate 311 arranged between the light-emitting plate 312 and the one-way vision film 32, and a supporting plate 313 arranged between the light-emitting plate 312 and the frame 1.

The light-emitting plate 312 is an area light source; and the light smoothing cover plate 311 is configured to uniformly disperse the light emitted by the light-emitting plate 312. A lateral side of the light smoothing cover plate 311 is provided with a clamping portion 3111; a lateral side of the light-emitting plate 312 is provided with a buckling portion 3121; and the clamping portion 3111 and the buckling portion 3121 cooperate to fixedly connect the light-emitting plate 312 and the light smoothing cover plate 311.

Connecting holes 3131 are correspondingly formed in the light-emitting plate 312 and the supporting plate 313; and the light-emitting component 31 further comprises a connecting member which passes through the connecting holes 3131 to fixedly connect the light-emitting plate 312 and the supporting plate 313. The supporting plate 313 is configured to support the light-emitting plate 312 and the light smoothing cover plate 311.

A limiting protrusion 3132 is arranged at a side of the supporting plate 313 away from the light-emitting plate 312, and is abutted against the frame 1 or the foaming layer to press the one-way vision film 32, so that the one-way vision film 32 clings to the LOGO display area 21.

An accommodating space 41 is reserved in the foaming layer to place the LOGO display device 3. In the embodiment, the accommodating space 41 is provided with an upward opening 411, so that the LOGO display device 3 can be placed into the accommodating space 41 through the opening 411 downwards. A handle area 3134 is protrusively arranged at the top end of the supporting plate 313, and is convenient to hold, so that the LOGO display device 3 can be mounted or replaced conveniently. Meanwhile, a fixing hole 3133 is further formed in the top of the supporting plate 313; and the supporting plate 313 and the frame 1 can be fixed together through a bolt and the like.

A human body sensing device is arranged on the refrigerator door 100, and is electrically connected to the LOGO display device 3. When detecting that someone approaches the refrigerator door 100, the human body sensing device sends a signal to the LOGO display device 3, and the LOGO display device 3 controls the light-emitting component 31 to emit light.

Of course, in other embodiments, other sensing devices may also be arranged to control the light-emitting component 31 to emit light under certain conditions. Or, a timer may be arranged to control the light-emitting component 31 to emit light during a certain period of time.

A manufacturing method of the refrigerator door 100 of the present invention comprises the following steps:

providing a frame 1;

providing a glass panel 2; printing a LOGO display area 21 on the glass panel 2 by using a multi-layer printing process, wherein a hollowed-out area is arranged on each printing layer, the hollowed-out areas on the multi-layer printing layers form the LOGO display area 21 correspondingly, and an error between the hollowed-out areas of the multi-layer printing layers is controlled to be less than 0.5 mm;

assembling the frame 1 and the glass panel 2 together;

providing a LOGO display device 3 which comprises a one-way vision film 32 and a light-emitting component 31; attaching the one-way vision film 32 on the LOGO display area 21, wherein attaching the one-way vision film 32 on the LOGO display area 21 is performed under a negative pressure environment, or before attaching, the LOGO display area 21 is coated with an optically clear adhesive; and foaming between the glass panel 2 and the frame 1 to form a foaming layer; reserving an accommodating space 41 at a side of the LOGO display area 21 facing the frame 1, wherein the accommodating space 41 has an opening 411; and mounting the light-emitting component 31 into the accommodating space 41 through the opening 411.

Another manufacturing method of the refrigerator door 100 provided by the present invention comprises the following steps:

providing a frame 1;

providing a glass panel 2; printing a LOGO display area 21 on the glass panel 2 by using a multi-layer printing process, wherein a hollowed-out area is arranged on each printing layer, the hollowed-out areas on the multi-layer printing layers form the LOGO display area 21 correspondingly, and an error between the hollowed-out areas of the multi-layer printing layers is controlled to be less than 0.5 mm;

assembling the frame 1 and the glass panel 2 together;

providing a LOGO display device 3 which comprises a one-way vision film 32 and a light-emitting component 31; attaching the one-way vision film 32 on the light-emitting component 31; and foaming between the glass panel 2 and the frame 1 to form a foaming layer; reserving an accommodating space 41 at a side of the LOGO display area 21 facing the frame 1, wherein the accommodating space 41 has an opening 411; mounting the light-emitting component 31 with the one-way vision film 32 into the accommodating space 41 through the opening 411; and enabling the one-way vision film 32 to be fit with the LOGO display area 21.

In the refrigerator door 100 and the manufacturing method thereof provided by the present invention, the transparent LOGO display area 21 is printed on the glass door body (the glass panel) 2, and the one-way vision film 32 and the light-emitting component 31 are arranged on the side of the LOGO display area 21, so that the LOGO display area 21 exhibits at least two states when the light-emitting component 31 emits or does not emit light. The human body sensing device is arranged on the refrigerator door 100, so that the light-emitting component 31 emits light when a user approaches the refrigerator door 100, thereby improving a human-machine interaction experience. In the manufacturing method of the refrigerator door 100, by improving the printing accuracy and reducing the printing error, a problem of a fuzzy boundary of the LOGO display area 21 in the prior art is solved. By attaching the one-way vision film 32 on the LOGO display area 21 under a negative pressure environment, or before attaching the one-way vision film 32, coating the LOGO display area 21 with the optically clear adhesive, bubbles between the one-way vision film 32 and the LOGO display area 21 are avoided, so that the light emitted by the light-emitting component 31 is prevented from being refracted.

The above embodiments are merely provided for describing the technical solutions of the present invention, but not intended to limit the same. Although the present invention has been described in detail with reference to the preferred embodiments, those skilled in the art will appreciate that the technical solutions of the present invention can be modified or replaced with equivalents, without departing from the spirits and scopes of the technical solutions of the present invention.

What is claimed is:

1. A refrigerator door, comprising: a frame, a glass panel arranged outside the frame, and a LOGO display device arranged between the frame and the glass panel, wherein a transparent LOGO display area is printed on the glass panel; the LOGO display device comprises a light-emitting component and a one-way vision film; the light-emitting component is arranged at a side of the LOGO display area close to the frame; and the one-way vision film is arranged between the LOGO display area and the light-emitting component wherein the light-emitting component comprises a light-emitting plate and a light smoothing cover plate arranged between the light-emitting plate and the one-way vision film; a lateral side of the light smoothing cover plate is provided with a clamping portion; a lateral side of the light-emitting plate is provided with a buckling portion; and the clamping portion and the buckling portion cooperate to fixedly connect the light-emitting plate and the light smoothing cover plate; and wherein the light-emitting component further comprises a supporting plate; connecting holes are correspondingly formed in the light-emitting plate and the supporting plate; and the light-emitting component further comprises a connecting member which passes through the connecting holes to fixedly connect the light-emitting plate and the supporting plate.

2. The refrigerator door of claim 1, wherein a side of the LOGO display area close to the one-way vision film is coated with an optically clear adhesive to enable the surface of the LOGO display area to be flat.

3. The refrigerator door of claim 1, wherein a limiting protrusion is arranged at a side of the supporting plate away from the light-emitting plate, and is abutted against the frame to press the one-way vision film, so that the one-way vision film clings to the LOGO display area.

4. The refrigerator door of claim 1, wherein a human body sensing device is arranged on the refrigerator door, and is electrically connected to the LOGO display device.

5. A method of manufacturing a refrigerator door, the method of manufacturing the refrigerator door comprising the following steps:

providing a frame;

providing a glass panel; printing a LOGO display area on the glass panel by using a multi-layer printing process, wherein a hollowed-out area is arranged on each printing layer, the hollowed-out areas on the multi-layer printing layers form the LOGO display area correspondingly, and an error between the hollowed-out areas of the multi-layer printing layers is controlled to be less than 0.5 mm;

assembling the frame and the glass panel together;

providing a LOGO display device which comprises a one-way vision film and a light-emitting component; attaching the one-way vision film on the LOGO display area; and foaming between the glass panel and the frame to form a foaming layer; reserving an accommodating space at a side of the LOGO display area facing the frame, wherein the accommodating space has an opening; and mounting the light-emitting component into the accommodating space through the opening.

6. The method of manufacturing the refrigerator door of claim 5, wherein attaching the one-way vision film on the LOGO display area is performed under a negative pressure environment.

7. The method of manufacturing the refrigerator door of claim 5, wherein before attaching the one-way vision film on the LOGO display area, the LOGO display area is coated with an optically clear adhesive.

8. The method of manufacturing the refrigerator door of claim 5, wherein a human body sensing device is arranged on the refrigerator door, and is electrically connected to the LOGO display device.

9. The method of manufacturing the refrigerator door of claim 5, wherein the light-emitting component comprises a light-emitting plate and a light smoothing cover plate arranged between the light-emitting plate and the one-way vision film; a lateral side of the light smoothing cover plate is provided with a clamping portion; a lateral side of the light-emitting plate is provided with a buckling portion; and the clamping portion and the buckling portion cooperate to fixedly connect the light-emitting plate and the light smoothing cover plate.

10. The method of manufacturing the refrigerator door of claim 9, wherein the light-emitting component further comprises a supporting plate; connecting holes are correspondingly formed in the light-emitting plate and the supporting plate; and the light-emitting component further comprises a connecting member which passes through the connecting holes to fixedly connect the light-emitting plate and the supporting plate.

11. The method of manufacturing the refrigerator door of claim 10, wherein a limiting protrusion is arranged at a side of the supporting plate away from the light-emitting plate, and is abutted against the frame to press the one-way vision film, so that the one-way vision film clings to the LOGO display area.

12. A method of manufacturing a refrigerator door, the method of manufacturing the refrigerator door comprising the following steps:

providing a frame;

providing a glass panel; printing a LOGO display area on the glass panel by using a multi-layer printing process, wherein a hollowed-out area is arranged on each printing layer, the hollowed-out areas on the multi-layer printing layers form the LOGO display area correspondingly, and an error between the hollowed-out areas of the multi-layer printing layers is controlled to be less than 0.5 mm;

assembling the frame and the glass panel together;

providing a LOGO display device which comprises a one-way vision film and a light-emitting component; attaching the one-way vision film on the light-emitting component; and foaming between the glass panel and the frame to form a foaming layer; reserving an accommodating space at a side of the LOGO display area facing the frame, wherein the accommodating space has an opening; mounting the light-emitting component with the one-way vision film into the accommodating space through the opening; and enabling the one-way vision film to be fit with the LOGO display area.

13. The method of manufacturing the refrigerator door of claim 12, wherein a human body sensing device is arranged on the refrigerator door, and is electrically connected to the LOGO display device.

14. The method of manufacturing the refrigerator door of claim 12, wherein the light-emitting component comprises a light-emitting plate and a light smoothing cover plate arranged between the light-emitting plate and the one-way vision film; a lateral side of the light smoothing cover plate is provided with a clamping portion; a lateral side of the light-emitting plate is provided with a buckling portion; and the clamping portion and the buckling portion cooperate to fixedly connect the light-emitting plate and the light smoothing cover plate.

15. The method of manufacturing the refrigerator door of claim 14, wherein the light-emitting component further comprises a supporting plate; connecting holes are correspondingly formed in the light-emitting plate and the supporting plate; and the light-emitting component further comprises a connecting member which passes through the connecting holes to fixedly connect the light-emitting plate and the supporting plate.

16. The method of manufacturing the refrigerator door of claim 15, wherein a limiting protrusion is arranged at a side of the supporting plate away from the light-emitting plate, and is abutted against the frame to press the one-way vision film, so that the one-way vision film clings to the LOGO display area.

* * * * *